US006595353B1

(12) United States Patent
Focke et al.

(10) Patent No.: US 6,595,353 B1
(45) Date of Patent: Jul. 22, 2003

(54) CIGARETTE PACKAGE

(75) Inventors: Heinz Focke, Verden (DE); Irmin Steinkamp, Seevetal (DE); Gisbert Engel, Luttum (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/786,989

(22) PCT Filed: Sep. 16, 1999

(86) PCT No.: PCT/EP99/06856

§ 371 (c)(1),
(2), (4) Date: Mar. 9, 2001

(87) PCT Pub. No.: WO00/20300

PCT Pub. Date: Apr. 13, 2000

(30) Foreign Application Priority Data

Oct. 6, 1998 (DE) ..... 198 45 894
Apr. 8, 1999 (DE) ..... 199 15 911

(51) Int. Cl.[7] ..... A24F 15/00

(52) U.S. Cl. ..... 206/245; 206/484; 206/273; 206/274

(58) Field of Search ..... 206/245, 264, 206/271, 273, 274, 484

(56) References Cited

U.S. PATENT DOCUMENTS

| | | | | | |
|---|---|---|---|---|---|
| 3,265,287 | A | * | 8/1966 | Hovland | 206/245 |
| 3,897,900 | A | * | 8/1975 | Gorski et al. | 206/264 |
| 4,100,718 | A | | 7/1978 | Focke et al. | |
| 4,184,305 | A | | 1/1980 | Baker | |
| 4,348,457 | A | * | 9/1982 | Rosenthal et al. | 428/349 |
| 4,508,218 | A | * | 4/1985 | Focke et al. | 206/271 |
| 4,741,145 | A | | 5/1988 | Bright | |
| 4,776,461 | A | * | 10/1988 | Focke et al. | 206/271 |
| 4,807,745 | A | * | 2/1989 | Langley et al. | 206/245 |
| 5,147,696 | A | * | 9/1992 | Lansbury et al. | 428/327 |
| 5,427,235 | A | * | 6/1995 | Powell et al. | 206/245 |
| 5,542,529 | A | * | 8/1996 | Hein et al. | 206/245 |
| 5,628,452 | A | * | 5/1997 | Sigrist et al. | 206/273 |
| 5,762,186 | A | * | 6/1998 | Focke et al. | 206/245 |
| 5,811,185 | A | * | 9/1998 | Schreck et al. | 156/305 |
| 6,228,458 | B1 | * | 5/2001 | Pinchen et al. | 206/242 |

FOREIGN PATENT DOCUMENTS

| | | |
|---|---|---|
| DE | 1913600 A | 10/1969 |
| DE | 2652079 A1 | 5/1978 |
| DE | 3124118 A1 | 2/1983 |
| GB | 710499 | 6/1954 |
| GB | 1128155 | 9/1968 |
| GB | 1315110 | 4/1973 |
| GB | 1510192 | 5/1978 |

OTHER PUBLICATIONS

Torta Research S.R.L. Remarks concerning the patentability of EP99947366.3 (Jan. 28, 2002).

* cited by examiner

*Primary Examiner*—Shian Luong
(74) *Attorney, Agent, or Firm*—Technoprop Colton LLP

(57) ABSTRACT

Cigarette pack, i.e. a soft pack, composed of a blank of thin, foldable packaging material, which is made of a paper layer and an outer plastic layer of thermally sealable material. Due to respective folding in the area of bottom wall (16), top wall (17) and side wall (15), folding webs partially overlap with outer plastic layers (19) directly facing each other and being sealed together or with the plastic layer being joined by sealing with the paper layer or a further inner layer.

34 Claims, 5 Drawing Sheets

12
14
15
16
17
21
22
23
24
25
26
27
30
31
32
33
40

48
18
51/53
19

48
18
20
51/53
19

27
43
42
44
46
45
38
36
33
39
52
29
54
25
49
X
X
53
29
26
48
28
51
24
28
27
22
12
14
13
21
35
37
31
35
32
34
30
52
34
33
54
47
10

10
41
42
43
44
45
46
47
48
50
51
53
54
55
56
57
17
21
22
24
25
26
12
13
14
40

CIGARETTE PACKAGE

BACKGROUND OF THE INVENTION

1. The invention relates to a cigarette pack, in particular a soft pack for cigarettes, comprising at least one blank of multi-layered packaging material, which encases a group of cigarettes, and folding webs are joined by thermal sealing.

2. Cigarette packs of sealable packaging material are known in different designs. An outer plastic foil casing for cigarettes is usually closed by thermal sealing of folding webs. Furthermore, cigarette packs of a complex multi-layered laminated fail are known. The manufacture of this type of pack is elaborate, in particular also due to the applied packaging material (U.S. Pat. No. 4,100,718).

BRIEF SUMMARY OF THE INVENTION

It is an object of the invention to suggest a cigarette pack which is preferably composed of one single blank of multi-layered packaging material but manufactured in a simple way and with relatively low material output.

In order to achieve this object, the inventive cigarette pack is characterized by the following features:

a) the packaging material is composed of at least one internally arranged paper layer and an outer plastic layer;

b) the outer plastic layer is composed of thermally sealable material, in particular polyethylene or polypropylene.

The packaging material preferably comprises an inside paper layer, which therefore faces the contents of the pack and is provided on its outer side with an thermally sealable plastic layer. On its inner side, a coating can alternatively be arranged on the paper layer, i.e. a metal layer or a plastic layer, preferably of high melting point.

According to the invention, this single, two- or three-layered packaging material is of particular significance in conjunction with the design of the soft cigarette pack, in particular in the embodiment of U.S. Pat. No. 5,762,186. The. Z-shaped folding used in this type of pack can be easily and durably manufactured with the inventive packaging material, i.e. in that two shanks of the Z-fold are joined to each other by thermal sealing continuously over their full surface or at least in partial areas. Sealing of the Z-fold can be applied in the area of a continuous length of material.

Furthermore, the bottom area of the pack corresponding with U.S. Pat. No. 5,762,186 with double-layered folding webs is designed in such a manner that the thermally sealable outer layers of the packaging material abut each other, so that a particularly tight, lasting seal can be achieved in the area of the bottom wall.

A further special quality of the cigarette pack lies in the design and arrangement of an opening aid also suitable for (soft cup) packs made of another packaging material. An opening web is defined in the region of a top wall by perforation or other weakened lines in the (inner) blank. The perforation line is not freely visible before the pack is opened.

Further features and details of the inventive cigarette pack will now be described in more detail, based on exemplary embodiments. Shown are, in

DETAILED DESCRIPTION OF THE PREFERRED EMBODIMENTS

Figures 1, 2, 3:
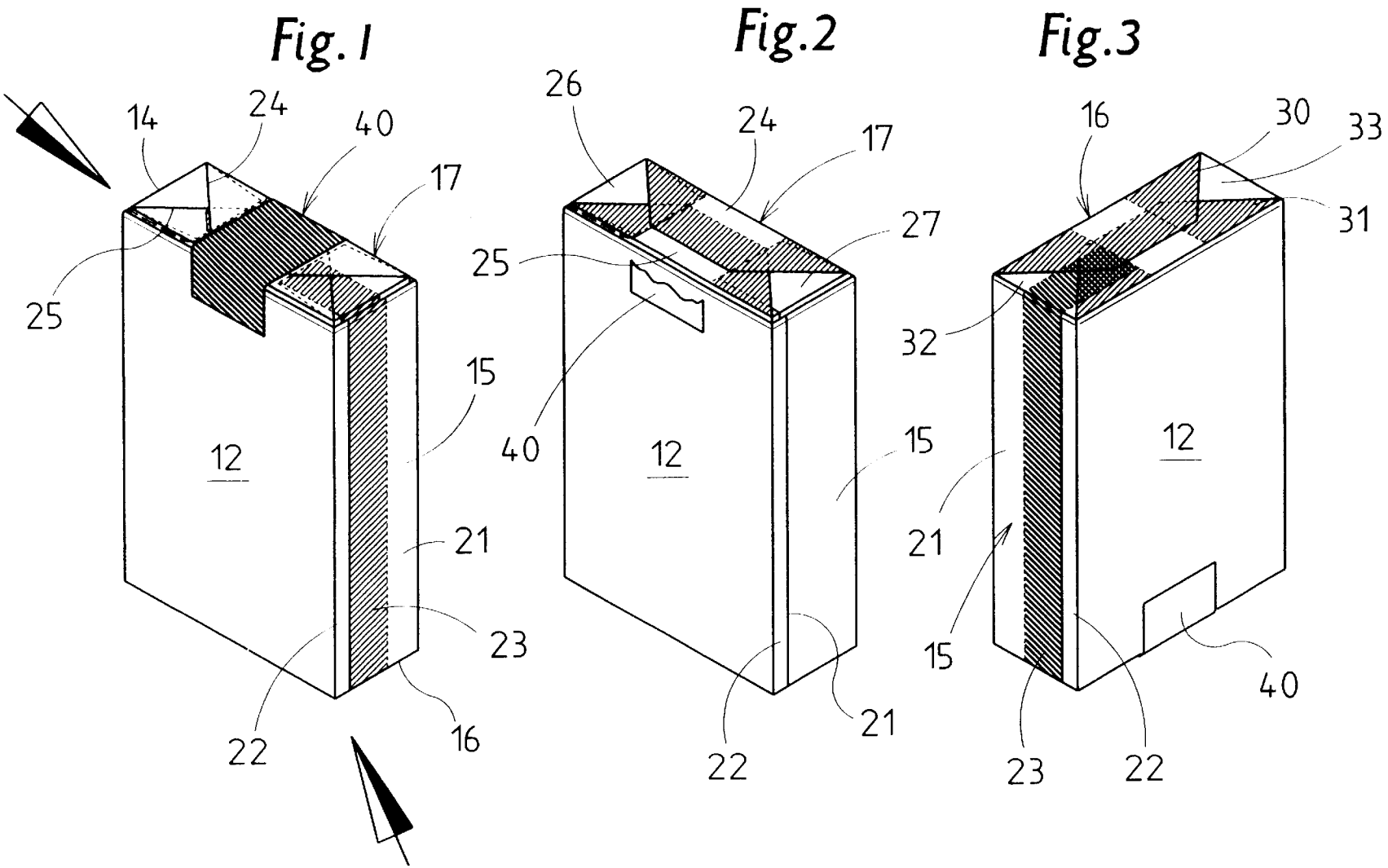
FIG. 1 A cigarette pack of the soft pack type, in a perspective view.
FIG. 2 the pack as in FIG. 1 without (revenue) strip.
FIG. 3 the pack as in FIG. 1 and 2 in a bottom view.

The drawings show details of soft packs for cigarettes, i.e. substantially in the embodiment according to U.S. Pat. No. 5,762,186. A pack of this type is composed of one single blank 10 of packaging material. It encases a group of cigarettes 11. The blank establishes a front wall 12, and opposite rear wall 13, two narrow upright side walls 14, 15, a bottom wall 16 and a top wall 17.

Blank 10 is made of special packaging material, i.e. of multi-layered structure. The main layer or support layer is a paper layer 18 which is at least at the outside laminated with plastic layer 19. The latter is composed of thermally sealable material, preferably polyethylene or polypropylene. At the inside, i.e. at the side facing toward cigarette group 11, a further layer can be applied by lamination, i.e. an inner layer 20. The latter can be made of plastic, but of a material with a melting point above sealing temperature. Alternatively, inner layer 20 can be made of metal, for example aluminum. A metallic inner layer can be applied to paper layer 18 by lamination or evaporation.

Figure 5:
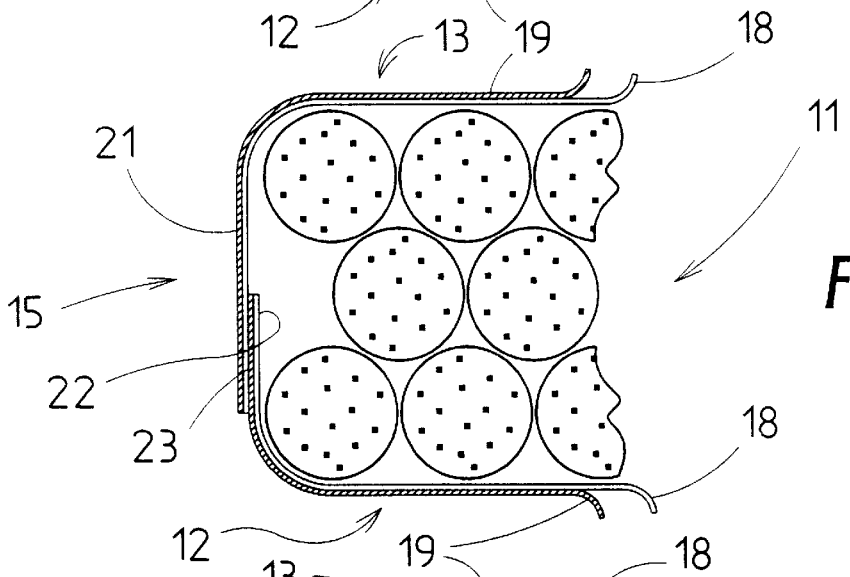
FIG. 5 an illustration analog FIG. 4 for another exemplary embodiment.

FIG. 5 illustrates an advantageous simple design of the packaging material with paper layer 18 as inside layer and an outer plastic layer 19.

Figure 6:
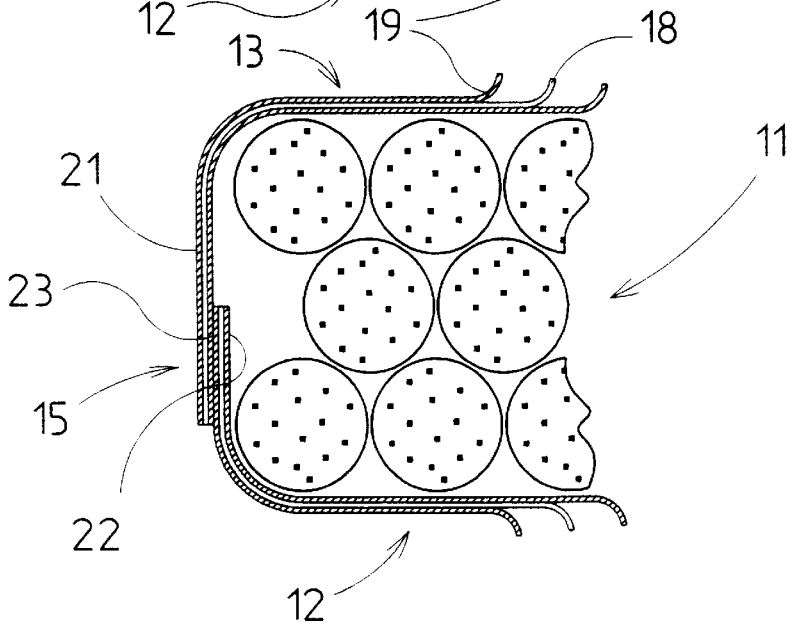
FIG. 6 an illustration as in FIG. 4 and FIG. 5 for a further exemplary embodiment.

FIG. 6 again shows a triple-layered structure. Inner layer 20 is here also made of plastic.

Figure 4:
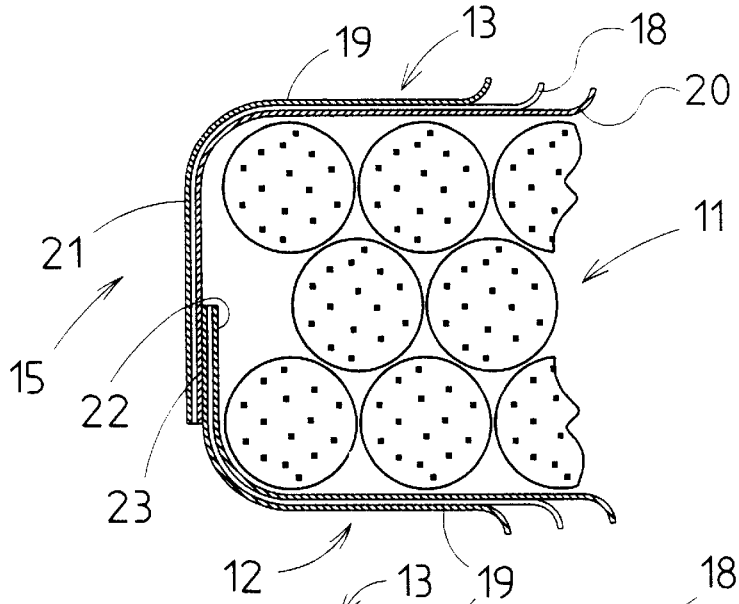
FIG. 4 a (horizontal) partial cross-section of the pack, at an enlarged scale.

For practical reasons, paper layer 18 is clearly thicker than the other layers, for example 60 g/m$^2$ (FIGS. 4 and 6) or 70 g/m$^2$ for a two-layered design (FIG. 5). Outer plastic layer 19 has a thickness of between 15 g/m$^2$ and 30 g/m$^2$.

The layer structure of blank 10 matches the illustrated design of the pack. The one-piece blank 10 encases cigarette group 11 in such a manner that edge strips 21, 22 partially overlap each other in the area of a side wall 15. These edge strips 21, 22 are joined together by sealing for the purpose of establishing side wall 15. The outside edge strip 21 is joined by heat and pressure to the outside, i.e. plastic layer 19 of inside edge strip 22. Depending on composition of the material, an inner layer 20 of plastic or metal or paper layer 18 is joined with outer plastic layer 19 of edge strip 22. This establishes a sealing strip 23, which is continuous over the full length of blank 11, approximately at the width of the overlap (shaded in FIGS. 1 and 2).

Top wall 17 and analog thereto bottom wall 16 are composed of folding webs which partially overlap each other. In the area of the top wall, trapezoidal longitudinal webs 24, 25 are respectively joined with rear wall 13 and front wall 14. In the area of top wall 17, side webs 26, 27 are adjacent side walls 14, 15. They lie at the inside, i.e. partially below longitudinal webs 24, 25. Side webs 26, 27 are joined to longitudinal webs 24, 25 via triangular folding gussets 28, 29. Folding gussets 28,29 are positioned below longitudinal webs 24, 25.

The folding webs of top wall 17 are joined together by thermal sealing. In the center area of top wall 17, the inside of outer longitudinal web 24 is joined to the sealable outside, i.e. plastic layer 19, of the inner longitudinal web 25. In the area of side webs 26, 27 as well as folding gussets 28, 29, the latter are joined by thermal sealing to triangular areas of side webs 26, 27. In this area, the outer plastic layers 19, 20 of folding webs 26, 27 lie on the one side and the folding webs 28, 19 on the other side adjacent each other, thus offering a particular firm seal. End wall 14 is then sufficiently sealed and virtually aroma-tight.

Bottom wall 16 can be of analog design. However, a special quality is offered in the present case. Longitudinal bottom webs 30, 31, lateral bottom webs 32, 33 and bottom folding gussets 34, 35 are of double-layered or double-walled design. For this purpose, blank 10 is provided at the bottom with a folding strip 36. The latter is folded along a folding edge 37 so as to form a double-layered strip. Folding is performed in such a manner that partial strips 38, 39 abut with the insides, i.e. either with paper layer 18 or inside layer 20 of another material. Folding webs 30 . . . 35 are sealable on both sides due to double-layered design, so that respective sealable surfaces, i.e. plastic layer 19, abut in the shaded areas of bottom wall 16. (FIG. 3). In this design, bottom wall 16 is particularly stable and lasting.

Folding strip 36 is designed or dimensioned in such a manner that a continuous edge strip 52 is established. The latter extends in a finished pack above bottom wall 16 around the inside as a peripheral reinforcing strip, as is illustrated in U.S. Pat. No. 5,762,186.

Present soft packs are in the area of top wall 17 provided with a (revenue) strip 40 which extends transversely thereabove. Paper strip 40 is here thermally sealed both to front wall 12 and rear wall 13 as well as top wall 17. In these areas, plastic layer 19 is turned respectively to the outside, so that strip 40 can be sealed on over the full surface corresponding with shaded markings in FIG. 1.

Figure 7:
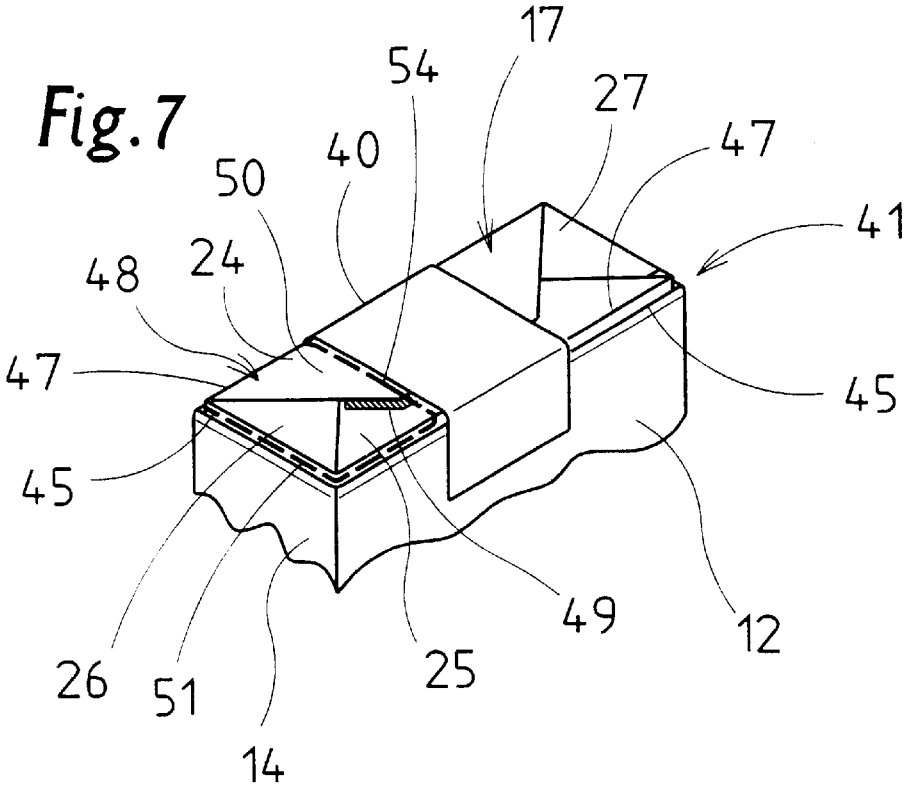
FIG. 7 an endsided area of the pack, in a perspective illustration.

A further special quality lies in that adjacent top wall 17 in the area of front wall 12, rear wall 13, side walls 14 and 15, is established a peripherally extending double fold, i.e. a Z-fold 41. The latter is composed of a material strip 42 of blank 10 with two shanks 43, 44 of Z-fold 41. Z-fold 41 is designed in such a manner that a lower folding edge 45 within the blank establishes the (apparent) upper edge of front wall 12, rear wall 13, etc. (FIG. 7). Due to the internally placed Z-fold 41, a lower folding edge 46 is externally not recognizable. An upper folding edge 47 establishes the transition into top wall 17. Z-fold 41 is designed in such a manner that both shanks 43 and 44 abut with their (external) plastic layers 19. Sealing along the Z-shaped folded material strip 42 produces a continuous joint of the shanks 43, 44.

A further special quality lies in the design of an opening aid in the area of top wall 17. The opening aid, i.e. a separable opening web 48, is created in that areas of folding webs which are to be joined by sealing are not joined by sealing due to their respective design. This allows an external folding web to be manually held and used for separation of opening web 48.

Figure 8:
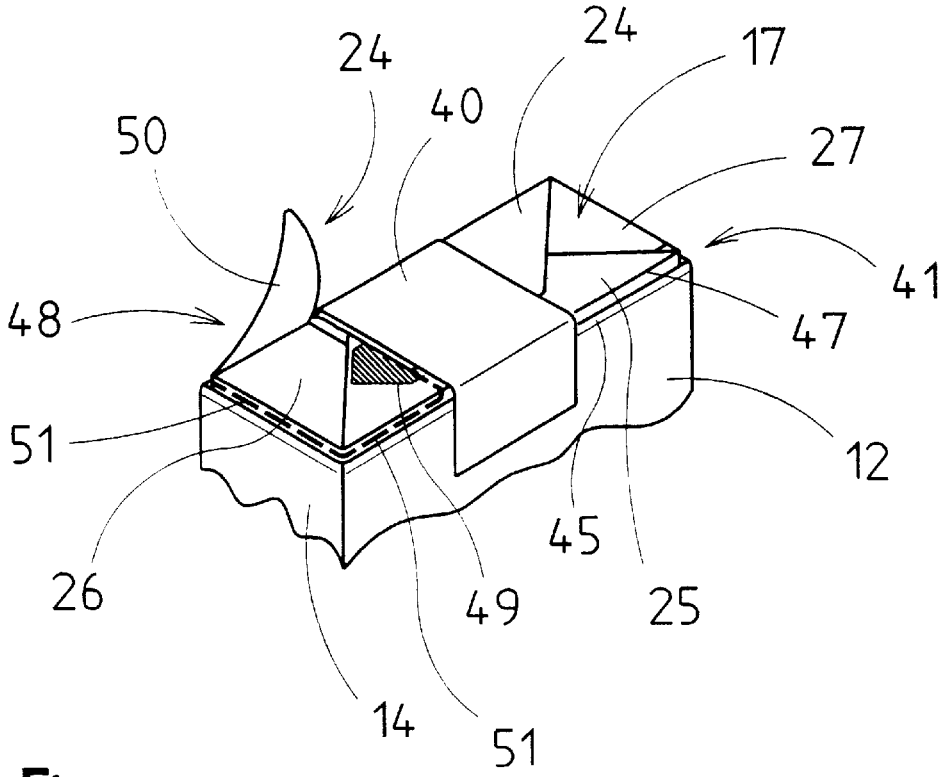
FIG. 8 the detail of FIG. 7 during opening of the pack.

A lateral area of outer longitudinal web 24, positioned along strip 40, is not connected to the facing (upper) side of lower longitudinal web 25. For this purpose, a protective layer 49 is applied to blank 10, i.e. at the top side of the (inner) longitudinal web 25, along strip 40. Protective layer 49 (protective lacquer) is arranged and designed in such a manner that a free edge area of longitudinal web 24 alongside strip 40 is grabbed and a triangular handling member 50 (FIG. 8) of opening web 48 can be separated from longitudinal web 24.

Openings web 48 is defined by a U-shaped weakened line 51 in blank 10. According to FIG. 9, weakened line 51 extends from the free edge of the blank in the area of both longitudinal webs 24, 25 to folding edge 46 or slightly therebeyond. Accordingly, opening web 48 encases parts of longitudinal webs 24, 25, side web 26 and folding gussets 28, 29. This completely separates an end area of top wall 17 along strip 40, thus establishing a virtually rectangular opening.

Figures 9, 10, 11:
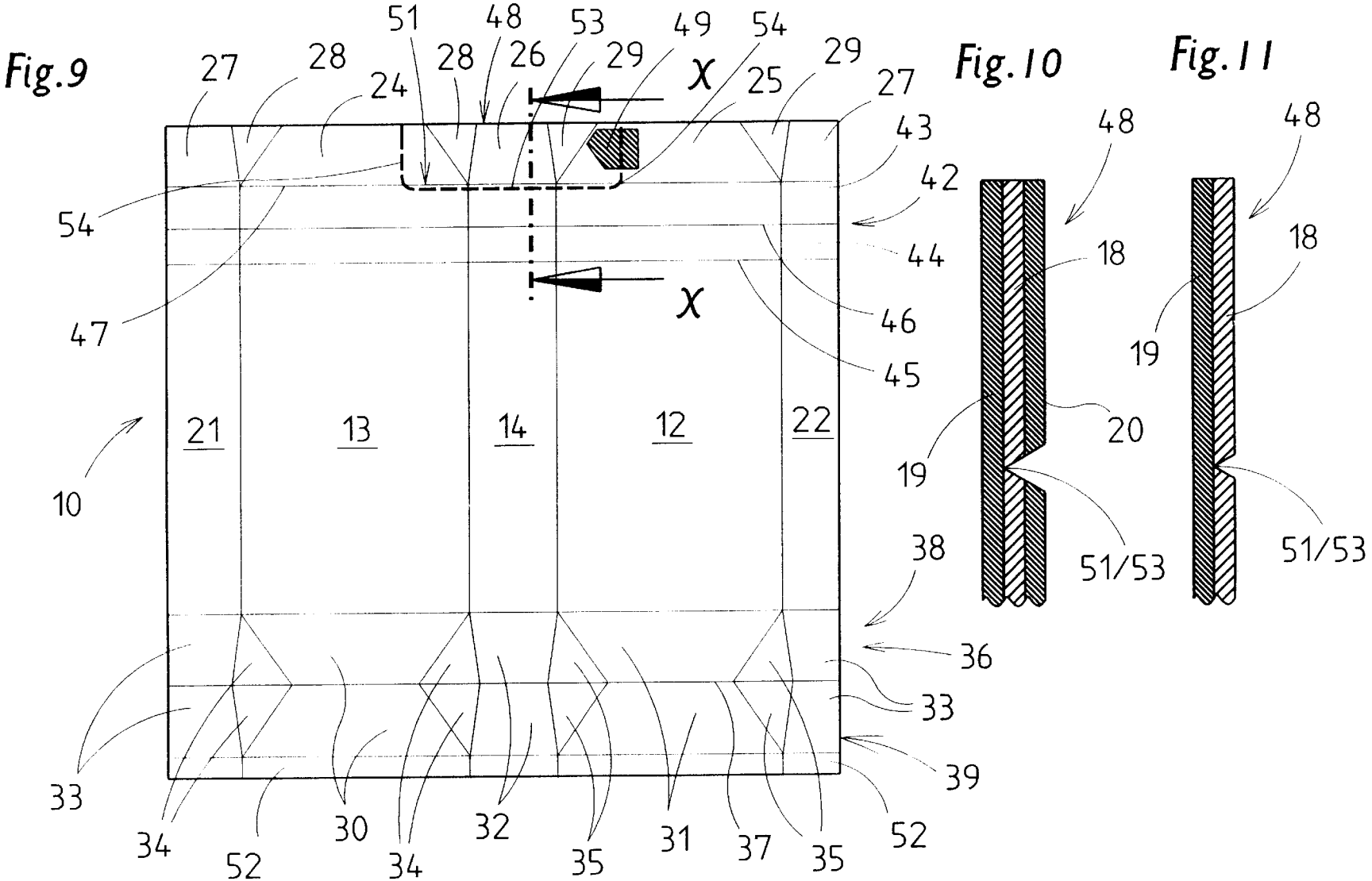
FIG. 9 a blank for the manufacture of packs as in FIG. 1 to FIG. 8.
FIG. 10 a cross-section through the blank of FIG. 9 along line X—X of FIG. 9.
FIG. 11 a cross-section as in FIG. 10 for another exemplary embodiment of the packaging material, each extensively enlarged.

The weakened line 51 can be designed as a perforation line. In the present case, however, a weakened line 51 is established, with the aid of a corresponding mechanical separating element or by a laser apparatus, which extends only over a portion of the cross-section of the packaging material, i.e. at the inside only in the area of paper layer 18 as well as—if available—in the area of inner layer 20 (FIG. 10 and 11). The outer layer or plastic layer 19 remains continuously intact but is severed due to low thickness when separating opening web 48.

The blanks according to FIG. 9 are produced from a continuous length of material with folding strips 36 as well as material strips 42 extending in the longitudinal-direction of the length of material.

The blank can be printed on the outside, i.e. in the area of the outer plastic layer, in the usual manner.

Figures 12, 13, 14:
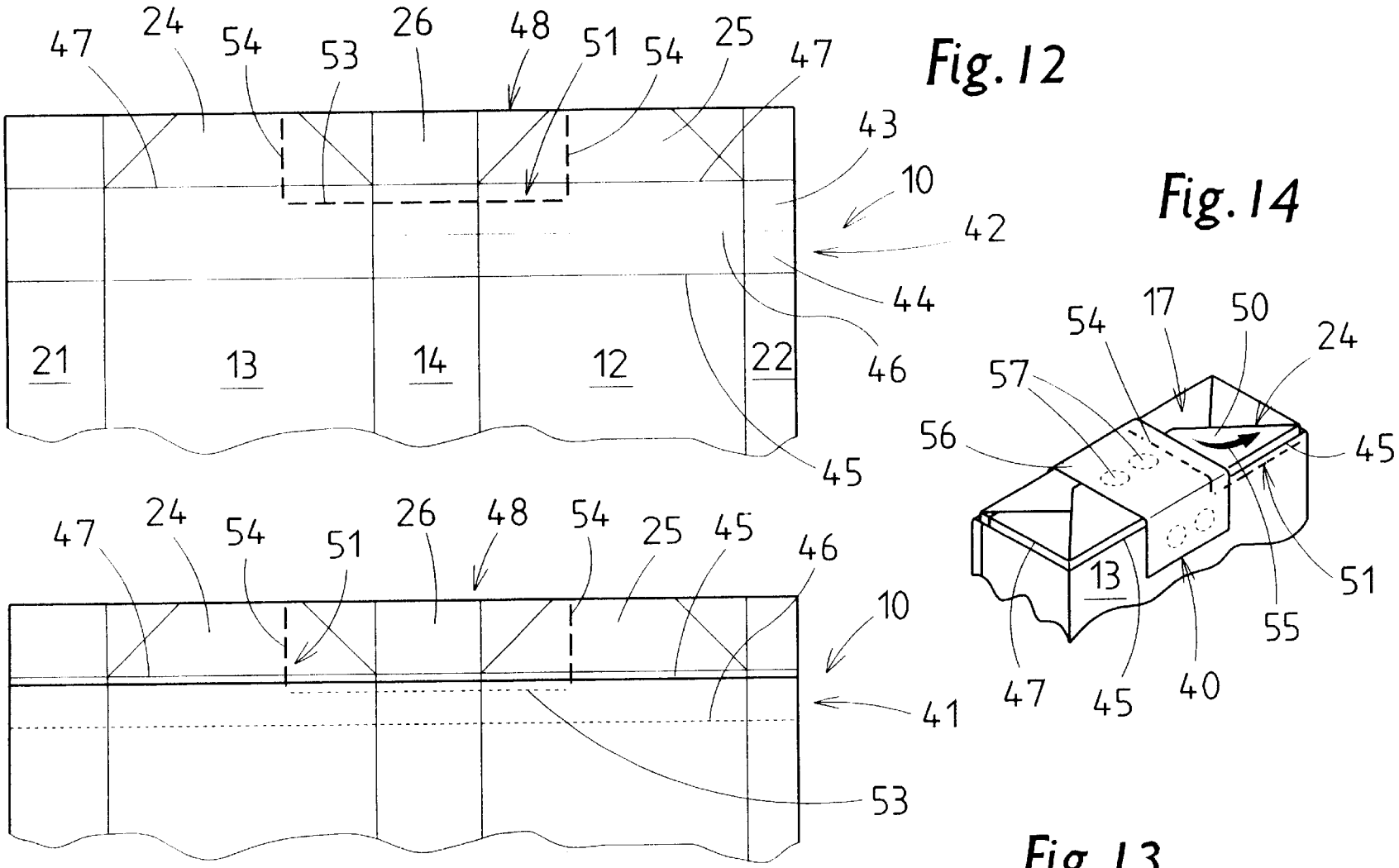
FIG. 12 an upper endsided area of a blank with an opening aid different than that of FIG. 9.
FIG. 13 the area of the blank according to FIG. 12 after the first folding step has been made.
FIG. 14 an endsided area of a cigarette pack of the soft cup type, in a perspective view.

FIG. 12, FIG. 13 and FIG. 14 show details of a (cigarette) pack in an embodiment modified with respect to an opening aid, namely an opening web 48 in the region of the top wall 17. The blank 10 employed in this embodiment can be configured in the described manner, but alternatively, is can also be made without having a sealable coating, thus being composed, for instance, of (coated) paper or the like.

Extending along the periphery of the upper area facing the top wall 17 is a double fold formed in the described manner, namely the Z-fold 41. Said fold is significant for the arrangement of the opening aid or opening web 48. A weakened line 51—which is U-shaped in the initial position (FIG. 12, FIG. 13) and which has a longitudinal shank 53 and transverse shanks 54—is positioned so that preferably the complete weakened line 51 cannot be seen on the (closed) pack but which nevertheless remains efficacious. For this purpose, the longitudinal shank 53 runs at a distance from folding edge 47 in such a manner that after formation of the Z-fold (FIG. 13) the longitudinal shank 53 of the weakened line 51 is covered by the Z-fold, namely lying underneath the folding edge 45 as an upper, visible edge of an (apparent) cup. (FIG. 13). In the finished pack (FIG. 14) the two mutually overlapping transverse shanks 54 for severing a part of the longitudinal webs 24, 25 also lie in a covered position, namely underneath the revenue strip 40 (FIG. 14). In order to open the pack with this design, a triangular- or trapezoid-shaped handle element 50 is, as usual, gripped and severed by a lifting motion, specifically along the outer transverse shank 54. By exerting further pulling action on the handle element 50 the entire opening web 48 is severed along the (covered) weakened line 51.

In order to indicate the presence of an opening aid more clearly, the handle element 50 of the longitudinal web 24 to be gripped is provided with a marking. In the exemplary embodiment according to FIG. 14 this is a printed arrow 55, which at the same time indicates the correct pulling-off direction. Alternatively, or as a supplement, an externally visible marking can be applied adjacent to the edge of the revenue strip 40 by making a notch or slit in the handle element 50.

Analogously, the opening aid according to FIG. 12 to FIG. 14 can also be utilized for cigarette packs of the soft-cup type in their conventional design, in which case the longitudinal shanks of the weakened line 53 are located underneath the upper edge of the soft cup (made from a specially designed blank).

In this exemplary embodiment the revenue strip 40 is attached to the pack by adhesive bonding, specifically in the region of a cross web 56 of the revenue strip 40 by means of two glue beads 57 arranged outside of the region of the weakened line 51.

What is claimed is:

1. A soft pack for cigarettes, comprising at least one blank (10) of multi-layered packaging material that encases a group of cigarettes (11) and folding webs that are joined by thermal sealing, wherein:

a) the packaging material is composed of at least an internally arranged paper layer (18) facing the cigarette group (11) and an external plastic layer (19);

b) the external plastic layer (19) is made of a thermally sealable material;

c) when the blank (10) is folded, the resulting soft pack comprises a front wall (12), a rear wall (13) and a side wall (14), a z-shaped fold (41) comprising a folding edge (45), and a weakened line (51) in the region of the intersection of the front wall (12), the rear wall (13) and the side wall (14);

d) the weakened line (51) comprising a longitudinal shank (53) delimiting a tear-off opening web (48) that is at least partially covered, when closed, by a revenue strip (40); and e) the longitudinal shank (53) of the weakened line (51) is positioned underneath the folding edge (45) of the z-shaped fold (41), underneath mutually overlapping transverse shanks (54) of the weakened line (51), and underneath a cross web (56) of the revenue strip (40).

2. The soft pack according to claim 1, characterized in that the paper layer (18) is located between the external layer and an inner layer (20) made of a material selected from the group consisting of metal or plastic and having a melting point greater than a temperature necessary for thermal sealing the folding webs.

3. The soft pack according to claim 2, characterized in that the folding webs proximal to one of the walls are joined by thermal sealing, and the external plastic layer (19) of the folding webs is joined by thermal sealing with the outer plastic layer (19) of another folding web.

4. The soft pack according to claim 2, characterized in that at least one of the folding webs proximal to at least one wall (17, 16, 15) are joined by thermal sealing, and the external plastic layer (19) of the folding webs is joined by thermal sealing with the external plastic layer (19) of another folding web.

5. The soft pack according to claim 1, characterized in that the folding webs are joined by thermal sealing, and the external plastic layer (19) of the folding webs is joined by thermal sealing with the external plastic layer (19) of another folding web.

6. The soft pack according to claim 1, characterized in that the folding webs proximal to a bottom wall (16) of the soft pack are double-walled such that the folding webs have on both sides an outwardly facing and thermally sealable external plastic layer (19).

7. The soft pack according to claim 1, characterized in that the z-shaped-folds (41) are double-layered and comprise shanks (43, 44) that abut the sealable external plastic layers (19) and are at least partially joined by thermal sealing.

8. The soft pack according to claim 1, characterized in that proximal to the top wall (17) surface areas of the blank (10) abut surface areas of the longitudinal webs (24, 25) are connected to each other by application of a protective layer (49) so that one area of the outer longitudinal web (24) can be grabbed and an opening web (48) is created by separation from the blank (10).

9. The soft pack according to claim 1, characterized in that an area of the blank (10) is established by at least the weakened line (51) and a separable opening web (48) along a strip (40) running transversely across the top wall (17).

10. The soft pack according to claim 9, characterized in that the weakened line (51) does not fully penetrate the multi-layered blank (10) and keeps the external plastic layer (19) closed.

11. The soft pack according to claim 9, characterized in that proximal to the blank (10) is a lateral area (17) of the top wall (10).

12. The soft pack according to claim 1, characterized in that the paper layer (18) of the multi-layered blank (10) has a thickness between three and five times greater than the surface thickness of the external plastic layer (19).

13. The soft pack according to claim 1, characterized in that the opening web (48) further comprises a handle element (50) having a marking as an opening aid.

14. The soft pack according to claim 13, characterized in that the marking is selected from the group consisting of a printed arrow (55) and a marking formed by stamping.

15. The soft pack according to claim 1, characterized in that the revenue strip (40) is attached to the soft pack by means of thermal sealing.

16. The soft pack according to claim 1, characterized in that the material of the external plastic layer (19) is selected from the group consisting of polyethylene and polypropylene.

17. The soft pack according to claim 1, characterized in that at least one of the folding webs proximal to at least one wall (17, 16, 15) is joined by thermal sealing, and the external plastic layer (19) of the folding webs is joined by thermal sealing with the external plastic layer (19) of another folding web.

18. The soft pack according to claim 1, characterized in that the paper layer (18) of the multi-layered blank (10) has a thickness between three and five times the thickness of the inner layer (20).

19. The soft pack according to claim 1, characterized in that the weakened line (51) for delimiting the tear-off opening web (48) is at least partially covered by the revenue strip (40) and by the Z-fold (41) when the pack is closed.

20. The soft pack according to claim 1, characterized in that the outer longitudinal web (24) comprises a handle element (50) that is provided with a marking as an opening aid.

21. The soft pack according to claim 20, characterized in that the marking is selected from the group consisting of a printed arrow (55) and a marking formed by stamping.

22. A cigarette pack comprising at least one blank having folding webs of a multi-layered packaging material, the multi-layered packaging material comprising a paper layer and at least one thermally sealable outer plastic layer at the outer side of the pack, wherein the cigarette pack encases a group of cigarettes, wherein:

a. at least two of the folding webs are located proximal to a wall of the pack and are joined by thermal sealing, with the outer plastic layer of a first of the folding webs being joined by thermal sealing with the outer plastic layer of a second of the folding webs; and b. the paper layer lies between the thermally sealable outer plastic layer and a second inside layer made of a material having a melting point that is greater than the temperature necessary for sealing the folding, webs.

23. The cigarette pack according to claim 22, wherein when the blank is folded to make the cigarette pack, the cigarette pack further comprises a double layer z-shaped fold comprising shanks lying on an outer side of the z-shaped fold adjacent to a top wall of the cigarette pack and which abut the outer plastic layer and which are at least in part areas joined by thermal sealing.

24. The cigarette pack according to claim 23, which the cigarette pack further comprises a bottom wall comprising a plurality of partially longitudinal webs and bottom side webs, and wherein:

a. the webs of the bottom wall are foldable and have a double-layer configuration created by a double-layer folding strip formed proximal to the bottom wall from two partial strips folded against one another;

b. the partial strips each comprise an inner layer, and the inner layers of a first partial strip lies against the inner layer of a second partial layer; and c. the webs formed from the double layer folding strip are connected to each other by means of thermal sealing of the outer plastic layers.

25. The cigarette pack according to claim 24, wherein the blank further comprises a top wall comprising a plurality of longitudinal webs and side webs that partially overlap each other so to form the top wall, the longitudinal webs comprise abutting surfaces that are provided with a protective layer of protective lacquer that prevents surfaces of the longitudinal webs from joining to each other by thermal sealing, and one area of one of the plurality of longitudinal webs can be grabbed for the purpose of severing an open web from the blank.

26. The cigarette pack according to claim 25, wherein the folding webs and the outer plastic layer are joined by thermal sealing, and the outer plastic layer of one of the folding webs is joined by thermal sealing with the outer plastic layer of another of the folding web.

27. The cigarette pack according to claim 26, further comprising a handle element that is provided with a marking as an opening aid, wherein the marking is produced by imprinting or by stamping.

28. The cigarette pack according to claim 26, wherein the top wall is created by at least one weakened line forming a separable opening web in a lateral area of the top wall adjacent to a strip running transversely across the top wall.

29. The cigarette pack according to claim 28, wherein the weakened line delimits a tear-off opening web and is at least partially covered by a revenue strip when the pack is closed.

30. The cigarette pack according to claim 29, wherein the weakened line delimits a tear-off opening web and is at least partially covered by the z-shaped fold when the pack is closed.

31. The cigarette pack according to claim 29, wherein the revenue strip is attached to at least one of the walls of the cigarette pack by thermal sealing, with the revenue strip comprising a sealable coating on its inner side.

32. The cigarette pack according to claim 28, wherein the weakened line only partially penetrates the materials of the blank and keeps at least the outer plastic layer closed.

33. The cigarette pack according to claim 32, wherein the paper layer of the blank has a thickness between three and five times greater than the thickness of the outer plastic layer or the inner layer.

34. The cigarette pack according to claim 33, wherein:

a. the weakened line is proximal to an intersection of the front wall, the rear wall and the side wall; and b. the weakened line further comprises a longitudinal shank and two mutually overlapping transverse shanks, with the longitudinal shank being positioned beneath an upper folding edge of the z-shaped fold and the two mutually overlapping transverse shanks, and underneath a cross web of the revenue strip.

* * * * *